US007136017B2

(12) United States Patent
Condon et al.

(10) Patent No.: US 7,136,017 B2
(45) Date of Patent: Nov. 14, 2006

(54) PIN FIN GROUND PLANE FOR A PATCH ANTENNA

(75) Inventors: Edward B. Condon, Murphy, TX (US); Richard L. Smith, Dallas, TX (US); John Grabner, Plano, TX (US)

(73) Assignee: Navini Networks, Inc., Richardson, TX (US)

( * ) Notice: Subject to any disclaimer, the term of this patent is extended or adjusted under 35 U.S.C. 154(b) by 52 days.

(21) Appl. No.: 11/003,255

(22) Filed: Dec. 3, 2004

(65) Prior Publication Data

US 2006/0071859 A1 Apr. 6, 2006

Related U.S. Application Data

(60) Provisional application No. 60/612,054, filed on Sep. 22, 2004.

(51) Int. Cl.
*H01Q 1/38* (2006.01)

(52) U.S. Cl. ..... 343/700 MS; 343/702

(58) Field of Classification Search ..... 343/700 MS, 343/702, 720, 853
See application file for complete search history.

(56) References Cited

U.S. PATENT DOCUMENTS 4,673,958 A * 6/1987 Bayraktaroglu ..... 331/107 R
6,621,468 B1 * 9/2003 Kanamaluru ..... 343/853

* cited by examiner

*Primary Examiner*—Michael C. Wilmer
(74) *Attorney, Agent, or Firm*—Preston Gates & Ellis LLP

(57) ABSTRACT

A system and method improves linearly-polarized microstrip patch antenna performance and fabrication through the incorporation of a pin fin ground plane and an integral antenna feed assembly. In one embodiment, a patch antenna system includes an antenna area with a patch antenna that provides radio communications. A heat dissipation member is coupled to the antenna area and includes a plurality of pins that provide for both the dissipation of heat from the antenna area and a ground plane for the antenna area. An antenna feed line is further coupled with the antenna patch for providing an electrical connection from the antenna patch to other electronic circuitries, such as a wireless device that may be mechanically coupled to the heat dissipation member. Heat generated during the operation of the wireless device is directed to ambient air by way of the heat dissipation member.

21 Claims, 3 Drawing Sheets

PIN FIN GROUND PLANE FOR A PATCH ANTENNA

CROSS REFERENCE

The present application claims the benefits of U.S. Provisional Patent Application Ser. No. 60/612,054, which was filed on Sep. 22, 2004 and entitled "CPE-Pin Fin Ground Plane for a Patch Antenna".

BACKGROUND

The present invention relates generally to patch antennas, and more particularly to the utilization of a pin fin ground plane structure for a linearly-polarized patch antenna.

Patch antennas are planar antennas used in wireless links and other microwave applications. A conventional linearly-polarized, single-band patch antenna consists of a dielectric substrate with a ground plane on the back-side of the dielectric substrate. On the front-side of the dielectric substrate is a square or rectangular conductive area also known as a "patch", which gives patch antenna its name. Typically a coaxial cable acts as a feed line to and from the "patch" for transmitting or receiving signals. In addition, the length of the patch in the direction of the feed is typically slightly less than half a wavelength of the operating frequency.

The ease of patch antenna fabrication on a flat substrate is a main selling point of the patch antenna. Though patch antennas have low gain as compared to large dish/parabolic type antennas, they can be arranged in an array to achieve higher gains. A commercial patch antenna, when opened up, typically involves an array of different shaped patches. For linearly-polarized radiation, the simplest patch element is a rectangle.

However, there are certain deficiencies with respect to a conventional patch antenna design. The resonant length of a conventional patch antenna is directly proportional to the intrinsic speed of light in the dielectric substrate over a flat ground plane, which is typically a published value for the substrate material. The radiating structure is a half wave resonating structure. An electric field exists between the patch and the ground plane. Since the field is not fully enclosed near its edges, fringing fields, which in turn is a source of radiation, are generated. Other factors also influence the resonant frequency of the patch antenna. These factors include: ground plane size, dielectric substrate thickness, metal (copper) thickness, and patch width (impedance). The width of the patch is chosen to provide a suitable radiation resistance and operational bandwidth.

Desirable in the art of linearly-polarized microstrip patch antenna, are improved patch antenna designs that provide for smaller size, lower weight, and decreased fabrication and assembly costs while maintaining conventional patch antenna performance.

SUMMARY

In view of the foregoing, this invention provides a structure and assembly methods to improve linearly-polarized microwave patch antenna fabrication and performance through the incorporation of a pin fin ground plane and an integral antenna feed assembly. The pin fin structure also acts as a heatsink.

In one embodiment, a patch antenna system comprises an antenna area with an antenna patch that provides radio communications. A heat dissipation area is coupled to the antenna area and comprises a plurality of pins and provides a ground plane for the antenna area. An antenna feed line is further coupled with the antenna patch for providing an electrical connection from the antenna patch to other electronic circuitries, such as a wireless electronic device. Unlike conventional patch antennas, the feed line and the antenna patch are fabricated as a single part. The ground plane of the antenna patch also serves as the ground plane for the feed line as well as an EMI shield. The new patch antenna design results in simplified fabrication and assembly processes, thereby lowering cost.

The construction and method of operation of the invention, however, together with additional objects and advantages thereof will be best understood from the following description of specific embodiments when read in connection with the accompanying drawings.

DESCRIPTION

The following will provide a detailed description of an improved patch antenna design.

Figure 1:
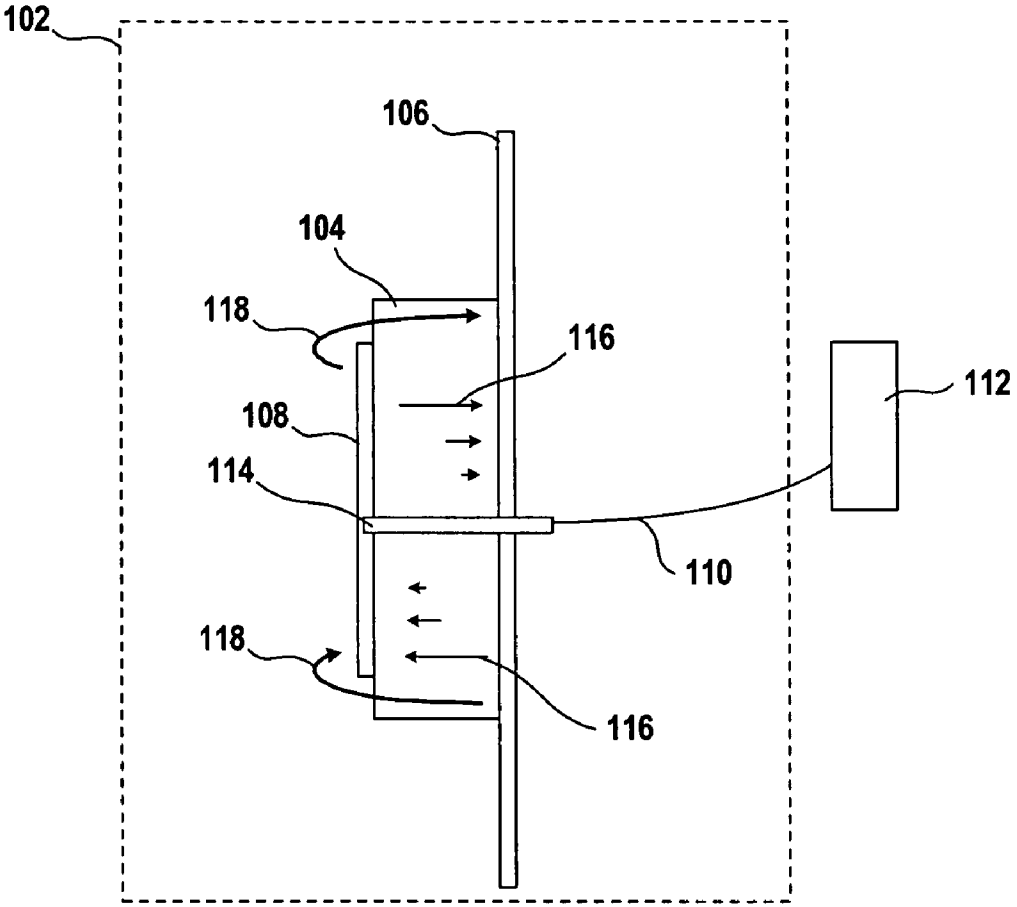
FIG. 1 (PRIOR ART)
FIG. 1 presents a diagram with a conventional linearly-polarized microstrip patch antenna.

FIG. 1 presents a diagram with a conventional linearly-polarized microstrip patch antenna 102. In other exemplary embodiments, patch antennas other than microstrip patch antennas may be used. The conventional patch antenna 102 includes a dielectric substrate 104, a ground plane 106 on the rear of the dielectric substrate 104, a conductive patch 108 on the front of the dielectric substrate 104, and a RF feed line 110, which is typically a coaxial cable. It is understood by those skilled in the art that the thickness of the dielectric substrate 104 is magnified for clarity, and thus is not indicative of proportions with respect to other elements presented in the diagram. A RF electronics module 112 connects to the conductive patch 108 via the RF feed line 110 and a probe feed 114. For example, in the transmit mode, a RF signal is created in the RF electronics module 112, conducted down the RF feed line 110 and the probe feed 114, and further conducted into the conductive patch 108. The RF energy: generates an electric field 116 between the conductive patch 108 and the ground plane 106. Since the electric field 116 is not fully enclosed near the edges of the conventional patch antenna 102, fringe fields 118 are created, which is the antenna radiation source. As another example, in the receive mode, a received radiated signal sets up a small electrical field within the conventional patch antenna 102. The signal is detected by the probe feed 114 and sent to the RF electronics module 112, via the RF feed line 110, for further processing.

Figure 2:
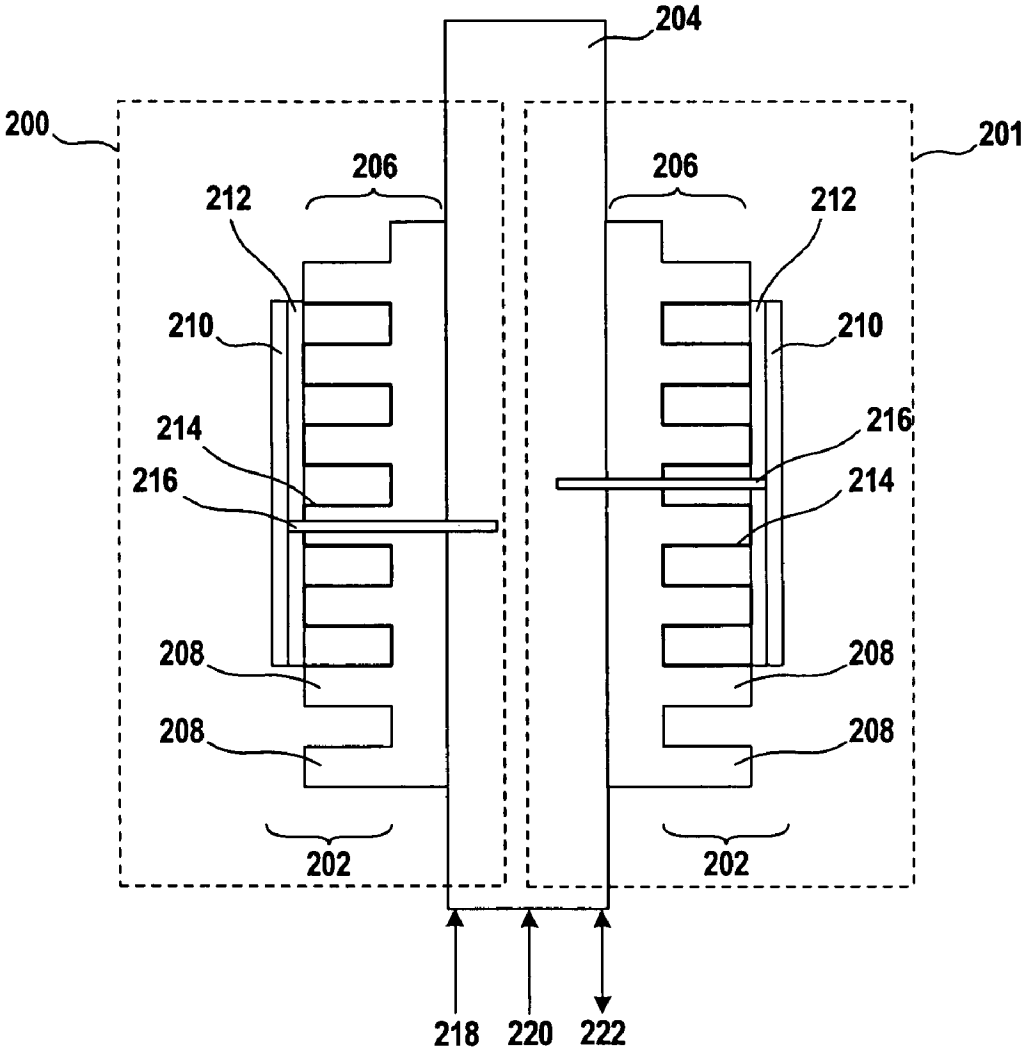
FIG. 2 presents a diagram with two linearly-polarized microstrip patch antennas in accordance with one embodiment of the present invention.

FIG. 2 presents a diagram with linearly-polarized microstrip patch antennas 200 and 201 in accordance with one embodiment of the present invention. The patch antennas 200 and 201 have a smaller size when compared with conventional patch antennas. Each of the patch antennas 200 and 201 has two functional areas: an antenna area 202 and a heat dissipation area or member 206. It is understood in each patch antenna, parts of the two functional areas, which may have overlapping areas, form an integrated single-piece structure. It is further understood that the integrated single-piece structure simplifies overall fabrication and assembly.

A wireless electronic device 204 is positioned between the two patch antennas 200 and 201 and may be oriented vertically in an exemplary embodiment. The wireless electronic device 204 may be a wireless modem but other wireless electronic devices may be used in other embodiments. The heat dissipation area 206, which may include a pin fin heatsink, is attached to both sides of the wireless device 204 to facilitate passive heat transfer from the device to ambient air. The heat dissipation area 206 is a structure having a plurality of pins 208 protruding from the surface of the heat dissipation area 206 to maximize the surface area for heat transfer. The heat dissipation area 206 may be formed of aluminum in an exemplary embodiment. It is understood that the pins 208 may include a cylindrical, elliptical, square or rectangular shape and may be formed of aluminum, other metals or other suitable heatsink materials. The heat dissipation area 206 also acts as an electromagnetic interference shield to prevent electromagnetic emissions to and from the wireless device 204.

The antenna area 202 of each of the patch antennas 200 and 201 comprises a patch 210, a dielectric substrate 212, and uses its mechanical connection with the heat dissipation area 206 as its ground plane. It is understood that while the antenna area 202 is mechanically connected to the heat dissipation area 206, it is also electrically isolated therefrom by the dielectric substrate 212.

One advantage of using the heat dissipation area 206 as the ground plane of the antenna areas 202, in lieu of a flat ground plane in a conventional patch antenna, is that the electrical length of the heat dissipation area 206 is larger than that of a flat ground plane in a conventional design. This is possible because the electrical length of the ground plane, formed by multiple pins 208 of heat dissipation area 206, is greater than the planar footprint of the heat dissipation area. As shown in FIG. 2, the electrical length of the ground plane, formed by dissipation area 206, is provided by a bold line 214. The length of the bold line 214 is much longer than the length of the patch 210, which would have been the maximum electrical length in a conventional design. By increasing the electrical length of the ground plane, a physically smaller patch antenna is possible while maintaining similar antenna efficiency as in the prior art.

Another feature of the patch antennas 200 and 201 is an integral antenna feed structure for the patch antenna. The body of the patch 210 and an antenna feed because line 216 are fabricated as one part, unlike conventional patch antenna designs. When the patch antennas 200 and 201 are installed, the antenna feed line 216 is electrically connected to the wireless device 204. Also, the ground plane of the patch antenna serves as the ground plane of the antenna feed structure. This integral antenna feed structure design provides a more consistent performance and a significant savings in assembly complexity and costs.

The wireless device 204 obtains its power from a connection 218, its ground at a connection 220, and its bidirectional LAN connection (Ethernet, Giga bit Ethernet, USB, etc) at a connection 222. The wireless device 204 transmits and receives the LAN signals to and from the patch antennas 200 and 201 via the antenna feed lines 216. By integrating the antenna areas 202, the heat dissipation areas 206, and the wireless device 204, a compact design with reduced size and reduced weight is provided.

FIG. 2 essentially presents a fully self-contained wireless data terminal incorporating two patch antennas 200 and 201 and a wireless device 204. The compact design achieved in this embodiment provides additional assembly cost and spatial savings without sacrificing antenna performance. The plurality of pins 208 provides two functions: the pins create an electrically larger ground plane for the patch antennas 200 and 201, thereby allowing a smaller patch antenna size, and dissipate heat from the wireless device 204 to ambient air for cooling. The aggregate surface that provides the ground plane includes the top and side surfaces of pins 208 and the common surface of the base members from which the pins 208 extend. In addition, the heat dissipation area 206 further acts as a ground plane for the antenna feed structure. This embodiment utilizes an integral antenna feed structure combining the patch antenna body and the antenna feed line as one structure, thereby reducing the assembly complexity and assembly time.

Figure 3:
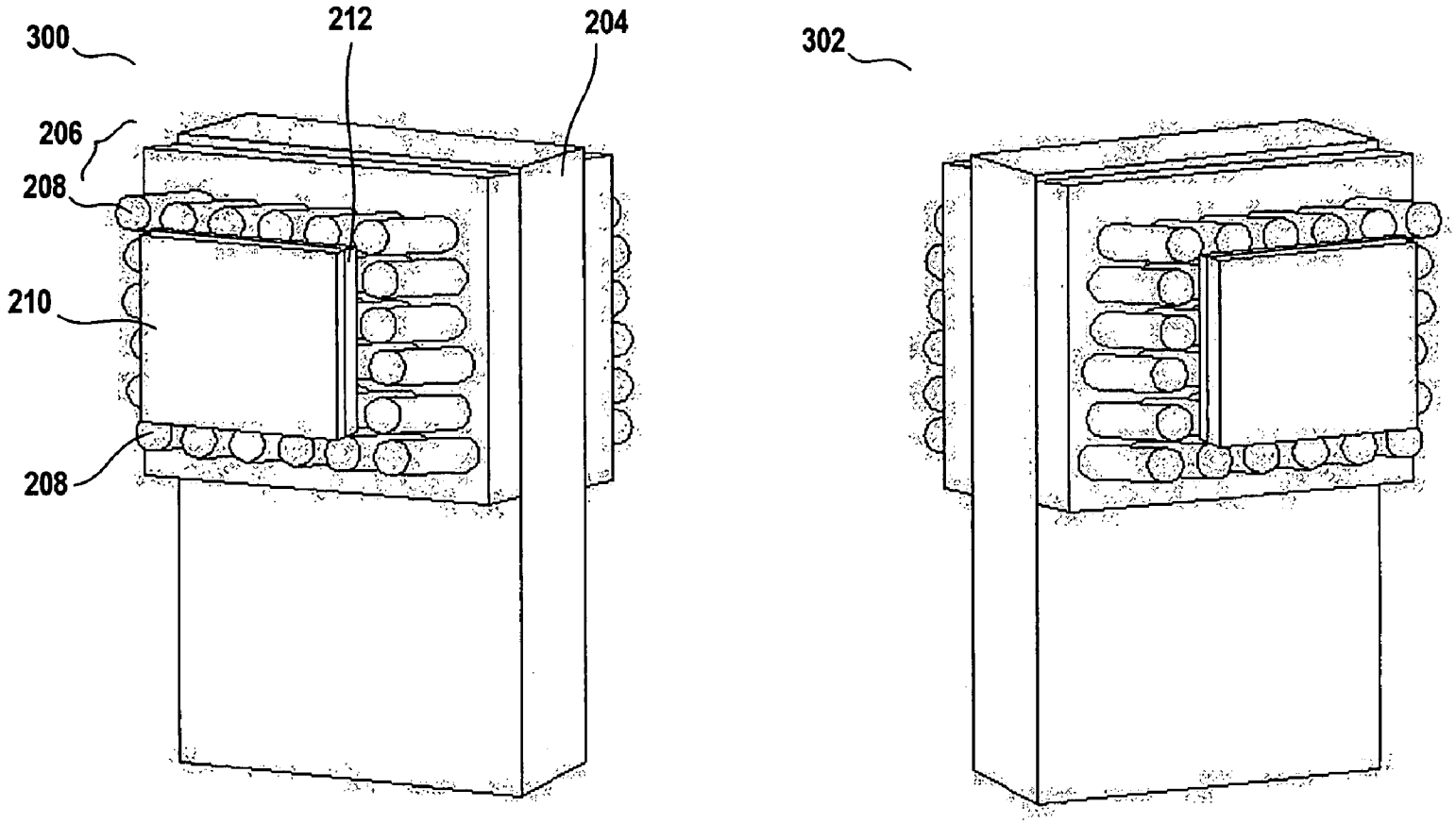
FIG. 3 presents two isometric views of the linearly-polarized microstrip patch antenna in accordance with one embodiment of the present invention.

FIG. 3 presents two isometric views 300 and 302 of the linearly-polarized microstrip patch antenna in accordance with one embodiment of the present invention. Pins 208 are arranged in a grid formation that is partially obscured in FIG. 3 by the antenna patch 210. It is understood that the isometric view 300 shows a patch antenna on one side of the wireless device 204, while the isometric view 302 shows a patch antenna on the other side of the wireless device 204. Views 300 and 302 may represent the front and back of a unit that includes the wireless device 204 arranged between opposed patch antennas that each include the heat dissipation area 206, which further includes the pins 208, the dielectric substrate 212 and the patch 210. This embodiment results in a compact efficient design of an integrated wireless device and patch antennas.

The above illustration provides many different embodiments or embodiments for implementing different features of the invention. Specific embodiments of components and processes are described to help clarify the invention. These are, of course, merely embodiments and are not intended to limit the invention from that described in the claims.

The invention also provides an assembly method for assembling and operating the components in the described configuration to form a patch antenna assembly. Conventional coupling methods may be used. The method includes forming multiple antenna patch systems as described above, and mechanically coupling a wireless device to two antenna patch systems by joining the wireless device to the heat dissipation members and each of the antenna feed lines, the heat dissipation member directing heat from the device to ambient air and the antenna feed line electrically coupling the antenna patch and the wireless device. The method includes electrically isolating the antenna patch from the heat dissipation member by forming the antenna patch on a dielectric substrate and positioning the dielectric substrate adjacent the heat dissipation member. At least one of the wireless device and the antenna patch is operated using conventional methods and generates heat. The heat dissipation member directs the heat generated by the wireless device and the antenna patch during operation, to ambient air. The method also includes providing power to the wireless device, grounding the wireless device and providing a bidirectional LAN connection (Ethernet, Giga bit Ethernet, USB, etc). The wireless device operation may include the device transmitting and receiving LAN signals to and from the patch antennas via the antenna feed lines.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims.

Accordingly, it is appropriate that the appended claims be construed broadly and in a manner consistent with the scope of the invention, as set forth in the following claims.

What is claimed is:

1. A patch antenna system comprising:

a patch antenna that provides radio communications;

a heat dissipation member mechanically coupled to the patch antenna and including a plurality of pins that dissipate heat from a patch antenna area, the heat dissipation member providing an aggregate surface that provides a ground plane for the patch antenna, the aggregate surface including at least surfaces of the pins; and an antenna feed line coupled to the patch antenna and providing an electrical connection between the patch antenna and further electronic circuitries, wherein the pins each include a top surface that is joined to a substrate upon which the patch antenna is disposed.

2. The patch antenna system of claim 1, wherein the patch antenna is a linearly-polarized, single-band patch antenna.

3. The patch antenna system of claim 1, wherein the pins are generally cylindrical in shape and include a circular, square, rectangular or elliptical cross section.

4. The patch antenna system of claim 1, further comprising a dielectric substrate disposed between the patch antenna and the plurality of pins, the dielectric substrate mechanically coupling the patch antenna formed thereon to the plurality of pins and providing electrical isolation therebetween.

5. The patch antenna system of claim 1, wherein the patch antenna and the antenna feed line each form part of one integral element.

6. The patch antenna system of claim 1, wherein the heat dissipation member comprises a heatsink.

7. The patch antenna system of claim 1, wherein the pins are arranged in a grid formation.

8. The patch antenna system of claim 1, wherein the pins are metallic.

9. The patch antenna system of claim 1 wherein each pin has a top surface and the top surfaces are co-planar and each contacts a dielectric substrate upon which the patch antenna is formed.

10. The patch antenna system of claim 1, wherein the heat dissipation member comprises the plurality of pins extending from a common surface of a base member and the aggregate surface further includes the common surface and the surfaces of the pins include top and side surfaces of the pins.

11. The patch antenna system of claim 1, further comprising a wireless device mechanically coupled to the heat dissipation member and electrically coupled to the antenna feed line, the heat dissipation member transferring heat from the wireless device, through the pins and to ambient air to cool the wireless device, and the antenna feed line electrically coupling the patch antenna and the wireless device.

12. The patch antenna system of claim 11, wherein the patch antenna and the antenna feed line are each part of one integral element.

13. The patch antenna system of claim 11, wherein the heat dissipation member comprises an electromagnetic interference shield that shields the wireless device from electromagnetic emissions.

14. An electronic component comprising:

a duality of patch antenna systems, each including:

a patch antenna that provides radio communications;

a heat dissipation member mechanically coupled to the patch antenna and including a plurality of pins that dissipate heat from an antenna area, the heat dissipation member providing an aggregate surface that provides a ground plane for the patch antenna; and an antenna feed line coupled to the patch antenna and providing an electrical connection from the patch antenna to other electronic circuitries, and a wireless device mechanically coupled to each heat dissipation member and mechanically and electrically coupled to each antenna feed line, the heat dissipation member directing heat from the device to ambient air and the antenna feed line electrically coupling the patch antenna and the wireless device.

15. The electronic component as in claim 14, wherein each aggregate surface comprises top and side surfaces of the pins and a common surface from which the plurality of pins extend.

16. The electronic component as in claim 14, wherein each patch antenna is formed on a dielectric substrate that contacts co-planar top surfaces of the pins.

17. The method of claim 16, further comprising operating at least one of the wireless device and the patch antenna thereby generating heat and the heat dissipation member directing the generated heat to ambient air.

18. A method for forming a patch antenna assembly, the method comprising:

mechanically coupling a patch antenna to a heat dissipation member having a plurality of heatsink pins and an aggregate surface that serves as a ground plane for the patch antenna;

electrically coupling the patch antenna to a wireless device using an antenna feed line; and mechanically coupling the heat dissipation member to the wireless device to provide a path of heat transfer from the wireless device to ambient air.

19. The method of claim 18, further comprising forming one integral unit that includes the patch antenna and the antenna feed line as parts thereof.

20. The method of claim 18, wherein the plurality of heatsink pins are joined to a common surface of a base member and the aggregate surface comprises the common surface and side and top surfaces of the pins.

21. The method of claim 18, further comprising electrically isolating the patch antenna from the heat dissipation member by forming the patch antenna on a dielectric substrate and positioning the dielectric substrate adjacent the heat dissipation member.

* * * * *